US005593051A

United States Patent [19]

Openchowski

[11] Patent Number: 5,593,051

[45] Date of Patent: Jan. 14, 1997

[54] SLACKLESS CUSHIONING DEVICE FOR RAILROAD CARS

[75] Inventor: Richard A. Openchowski, Bolingbrook, Ill.

[73] Assignee: National Castings Incorporated, Downers Grove, Ill.

[21] Appl. No.: 356,917

[22] Filed: Nov. 14, 1994

[51] Int. Cl.[6] ..... B61G 9/00

[52] U.S. Cl. ..... 213/47; 213/44; 213/50; 213/56; 213/67 R; 213/69

[58] Field of Search ..... 213/40 R, 41, 213/44, 45, 47, 48, 56, 60, 61, 67 R, 50, 64, 69

[56] References Cited

U.S. PATENT DOCUMENTS

| | | | |
|---|---|---|---|
| 2,241,353 | 5/1941 | Kinne et aal. | 213/67 R |
| 5,113,548 | 5/1992 | Chi | 213/67 R |
| 5,115,926 | 5/1992 | Kaufhold | 213/61 |
| 5,221,015 | 6/1993 | Mautino et al. | 213/67 R |
| 5,360,124 | 11/1994 | Wurzer et al. | 213/67 R |
| 5,427,257 | 6/1995 | Hanes et al. | 213/67 R |

FOREIGN PATENT DOCUMENTS

| | | | |
|---|---|---|---|
| 1258258 | 8/1989 | Canada | 213/61 |
| 2248217 | 4/1992 | United Kingdom | 213/61 |

*Primary Examiner*—Mark T. Le

[57] ABSTRACT

A railroad car coupling mechanism is described as having a yoke which is disposed within, I) a carsill which is attached to the underside of a railroad car adjacent each of the opposing ends of the car, and II) a striker which is secured to the subsill and railroad car. The striker and carsill carry front and rear stops between which the yoke extends and engages the front stops. At least one resilient load cushing device is disposed between the straps of the yoke for cushioning loads impacting the car coupling mechanism. At least one wedging device is disposed within the yoke straps, in tandem, with the load cushioning device, for taking up any slack which develops from worn parts within the yoke. At least one wedging mechanism is disposed outside the yoke between the back end of the yoke and the rear stops to, likewise, take up slack and insure that the yoke remains firmly, in place, between the front and rear stops.

32 Claims, 4 Drawing Sheets

SLACKLESS CUSHIONING DEVICE FOR RAILROAD CARS

BACKGROUND OF INVENTION

The invention relates to railroad cars, especially the car coupling mechanisms used to join adjacent railroad cars together to form a train. More particularly, the invention relates to an improvement in a slackless, resilient cushioning car coupling mechanism which is exemplified in U.S. Pat. No. 5,131,548 which discloses a unique, slackless, resilient drawbar connector or coupling mechanism which is positioned within the attached housings of a striker and carsill which, in turn, are secured to the underside of a railroad car at each of the opposing ends of the car.

The car coupling drawbar mechanism of this patent comprises, I) a yoke which is positioned between a pair of front stops carried by the striker and a pair of rear stops carried by the carsill, II) a resilient load cushioning device disposed within the yoke for cushioning loads which impact the drawbar, and III) a wedging device disposed in the yoke, in tandem, with the load cushioning device to take up any slack caused by worn parts within the yoke, to insure that the front follower stays in compressive seated relation with the butt end of the drawbar.

The car coupling mechanism of this patent performs well and does a fine job of absorbing impact loads and eliminating slack which develops within the yoke, but nothing is provided to take up any slack which develops between the yoke and the stops carried by the striker and carsill. The invention is designed to eliminate or substantially reduce any such undesirable slack which may develop between the yoke and the front and rear stops of the striker and carsill.

Briefly stated, the invention is in a railroad car coupling mechanism which essentially comprises, a) a yoke disposed longitudinally between front stops on the striker and rear stops on the carsill attached to the underside of a railroad car at each of the opposing ends of the car, the yoke being in contact with the front stops, b) at least one resilient cushioning device disposed within the yoke for cushioning loads impacting a coupler shank to which the yoke is pinned, c) at least one wedging device disposed within the yoke, in tandem, with the cushioning device for taking up slack which develops between worn parts within the yoke, and d) means disposed outside the yoke between the yoke and rear stops for taking up slack which develops between the yoke and the front and rear stops of the striker and carsill.

Also described is a second, resilient cushioning device which can be positioned outside or inside the yoke to help absorb loads impacting the car coupling mechanism of the invention.

DESCRIPTION OF DRAWING

The following description of the invention will be better understood by having reference to the accompanying drawing, wherein:

FIGS. 3–8 show embodiments of the invention in connection with a portion of a coupler shank which can be the shank of an AAR Standard coupler or drawbar, as seen in FIGS. 1 and 2.

DETAILED DESCRIPTION OF DRAWING

Figure 1:
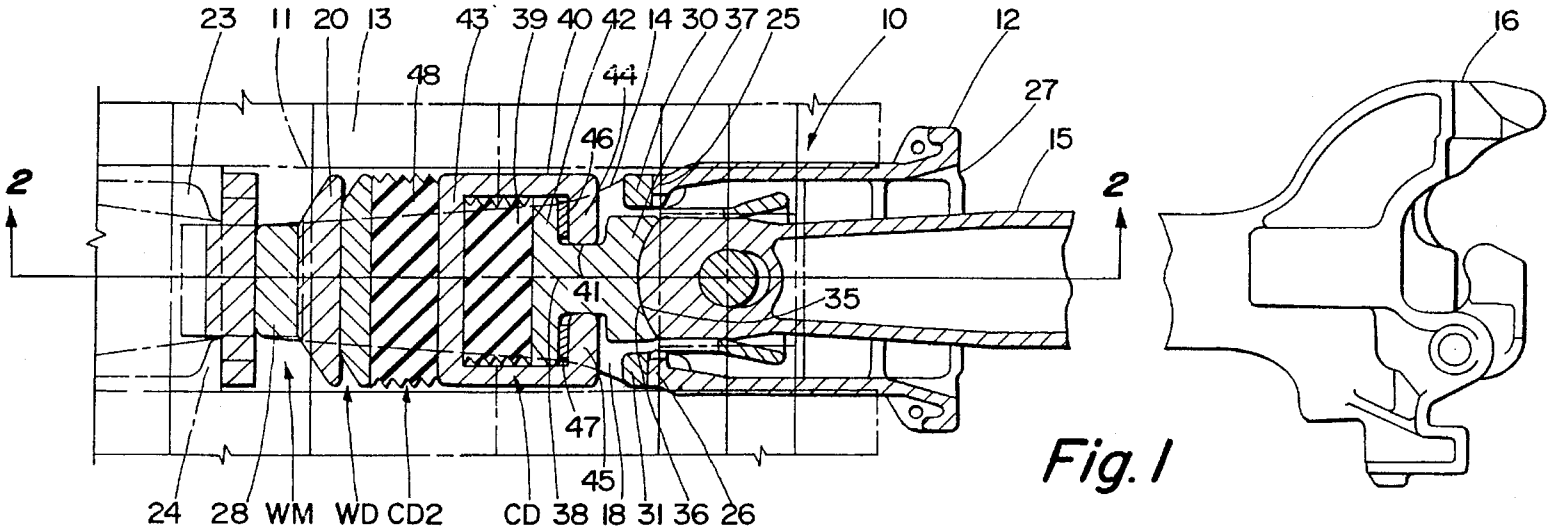
FIG. 1 is a plan view of a section of a first embodiment of the invention, as seen from the line 1—1 of FIG. 2, the section being shown in conjunction with, for example, an AAR Standard F type coupler.
Figure 2:
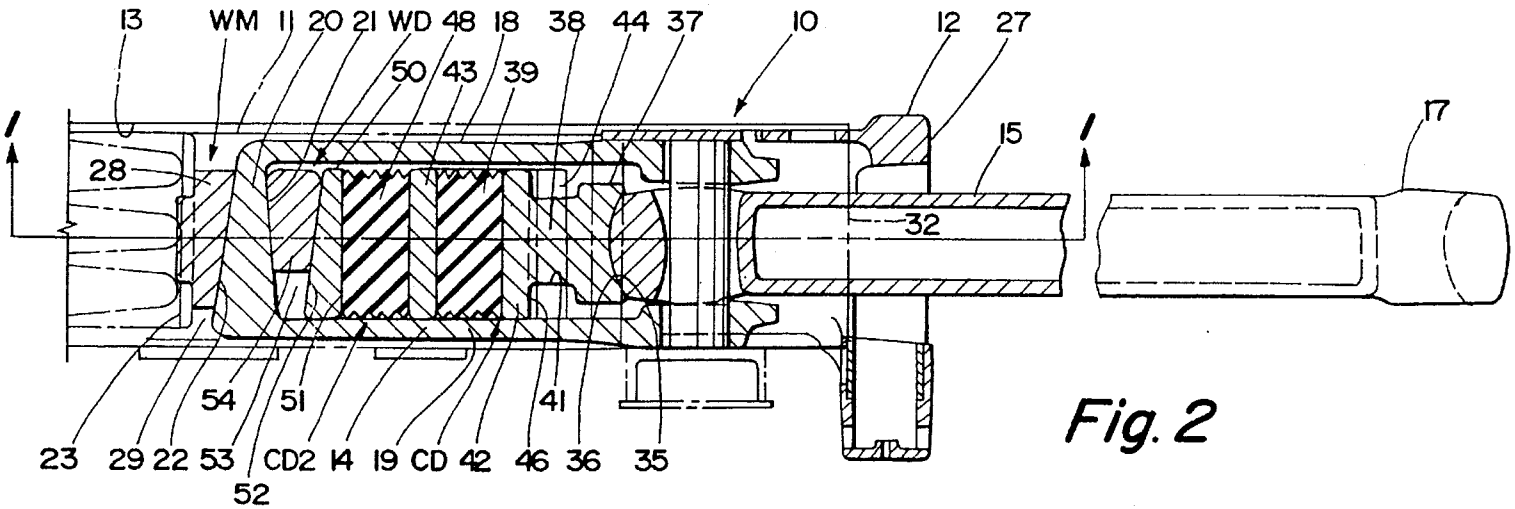
FIG. 2 is a side view of a section of the first embodiment, as seen from the line 2—2 of FIG. 1, this section being shown in conjunction with a drawbar which can be alternately used instead of a conventional AAR Standard coupler.

With general reference to the drawing for like parts, and particular reference to FIGS. 1 and 2, there is shown a railroad car coupling mechanism 10 which, for explanation and claiming purposes, is assumed to be in a horizontal position within the attached housings of a carsill 11 and striker 12 which are secured together to the underside of a railroad car 13 at each of the opposing ends of the car 13.

The coupling mechanism 10 comprises a horizontally elongated, specially designed yoke 14 which is conventionally pinned to the coupler shank 15 of an AAR Standard coupler head 16 or drawbar 17. The yoke 14 comprises upper and lower sides or straps 18 and 19 which extend rearwardly from the striker 12 in parallel relation in a direction away from the coupler shank 15 into the carsill 11 where the yoke straps 18 and 19 terminate at a back end 20 that has a pair of vertically sloping, inner and outer sides 21 and 22 which diverge downwardly in a direction away from the juxtaposed railroad car 13.

A first, wedging mechanism, generally indicated at WM, is disposed between the back end 20 of the yoke 14 and a pair of vertically aligned, projecting rear stops 23 and 24 which are disposed deep within the carsill 11 in longitudinal spaced relation from a pair of front stops 25 and 26 which are vertically disposed on the striker 12 in spaced relation from the front end 27 thereof. The first wedging mechanism WM comprises a movable and tapered, first wedge 28 which is designed to slidably engage the rear stops 23 and 24 and the sloping, outer back side 22 of the yoke 14, which form between them a matingly shaped space or notch 29 for receipt of the first wedge 28, which will fall, by gravity, deeper into the space 29 should it widen and increase, in size, as a result of slack developing between the yoke 14 and stops 23–26.

The yoke straps 18 and 19 carry between them a pair of vertically elongated, continuous abutments 30 and 31 which are designed to engage the front stops 25 and 26 which project from the striker 12. Thus, the wedging mechanism WM acts to eliminate any slack which develops between the yoke 14 and the front and rear stops 25,26 and 23,24, of the striker 12 and carsill 11, to keep the yoke 14 firmly, in place, between the stops and prevent chattering of the yoke 14 within the carsill 11 and striker 12.

It should be apparent to those skilled in the art that the striker 12 can be eliminated when a drawbar 17 is used. In such cases, the front stops 25 and 26 are secured to the front end 32 of the carsill 11, since such stops are necessary to maintain the coupling mechanism 10, in position, within the carsill 11.

The coupler shank 14 has a parti-spherical butt end 35 which is almost in lateral alignment with the front stops 25 and 26, and which is seated in a matingly shaped cavity 36 of an adjacent, axially aligned front follower 37 that is disposed between the yoke straps 18 and 19. The front follower 37 has a T-shaped tail 38 which extends rearwardly of the front follower 37 in a direction towards the back end 20 of the yoke 14 for engagement with a first, resilient load cushioning device, generally indicated at CD.

The load cushioning device CD comprises at least one vertically disposed, resilient cushion pad 39 which is partially enclosed in a housing 40 which has an opening 41 that confronts the front follower 37. The T-shaped tail 38 of the front follower 37 extends through the opening 41 into the housing 40, and includes an integral rigid, flat plate 42 which is vertically disposed within the housing 40 for compressive engagement with the at least one resilient cushion pad 39 which, for example, is formed of a plurality of parallel, flat metal plates which are embedded in a resilient rubbery material. The at least one cushion pad 39 is disposed between the flat plate 42 of the front follower 37 and the adjacent, parallel back end 43 of the housing 39. The opening 41 in the housing 40 is defined between a pair of vertically disposed and laterally spaced, coplanar front flanges 44 and 45 which are parallel to the back end 43 of the housing 40.

A pair of flat, rectangular shims 46 and 47 are positioned between the front flanges 44 and 45 of the housing 40 and the flat plate 42 of the front follower 37 to press the flat plate 42 against the at least one cushion pad 39 to preload the cushion pad 42. The thickness of the shims 46 and 47, measured longitudinally of the yoke 14, is correlated to the preload of the cushion pad 42 and can be varied, as desired.

A second, resilient load cushioning device, generally indicated at CD2, is disposed between the yoke straps 18 and 19 behind the first load cushioning device CD in closer spaced relation to the rear stops 23 and 24. The second cushioning device CD2 consists of a single, similarly formed, resilient cushion pad 48 which is vertically disposed in axial alignment with the at least one cushion pad 39 within the housing 40, between the back end 43 of the housing 40 and a first wedging device, generally indicated at WD.

The first wedging device WD comprises a normally immovable, generally triangular or wedge shaped, rigid element or plate 50 which has a flat, vertically disposed front side 51 that abuts the cushion pad 48 of the second cushioning device CD2, and a back side 52 which slopes downward in a direction towards the inner, back side 21 of the yoke 14, and forms with such inner back side 21, a generally V-shaped space or notch 53 for receipt of a movable and matingly shaped, twin tapered, second wedge 54 which is. designed to fall, by gravity, deeper into the notch 53 when it widens and increases, in size, as slack develops within the yoke 14, as a result of wear of any of the components therein.

Thus, there has been described, a first embodiment which essentially comprises, I) a two stage cushioning device which is disposed within the yoke 14, in tandem, with a wedging device which is positioned behind the cushioning device for eliminating slack within the yoke 14, and II) a wedging mechanism outside the yoke 14 for eliminating any slack which develops between the yoke 14 and the front and rear stops 25,26, and 23,24.

In operation, loads impacting the coupling mechanism 10, are first absorbed by the first cushioning device CD, until the front follower 37 moves rearwardly to a point where it engages the front flanges 44 and 45 of the CD housing 40, after which the front follower 37 and housing 40 move as a unit into compressive engagement with the second cushioning device CD2. Any slack which develops as a result of set in the cushion pads 39 and 48 after the load is removed, or because of wear of the various parts within the yoke 14, will be taken up by the second wedge 54 as it falls, by gravity, further or deeper into the notch 53.

Figure 3:
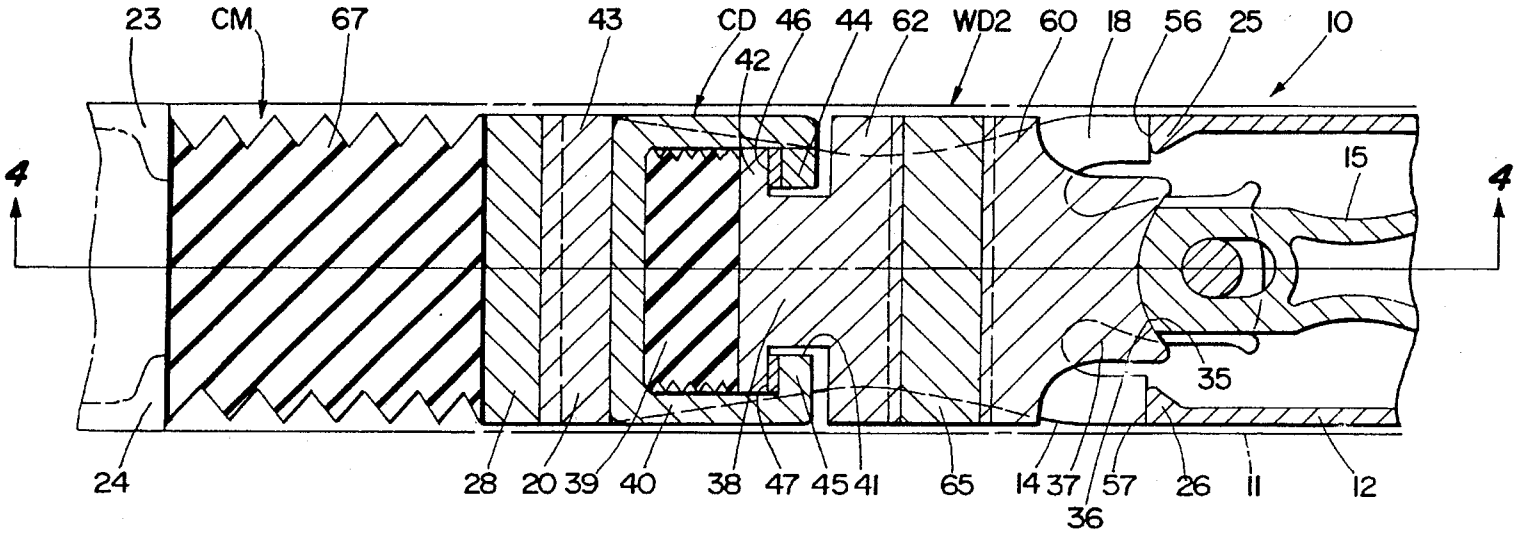
FIG. 3 is a plan view of a section of a second embodiment of the invention, as seen from the line 3—3 of FIG. 4.
Figure 4:
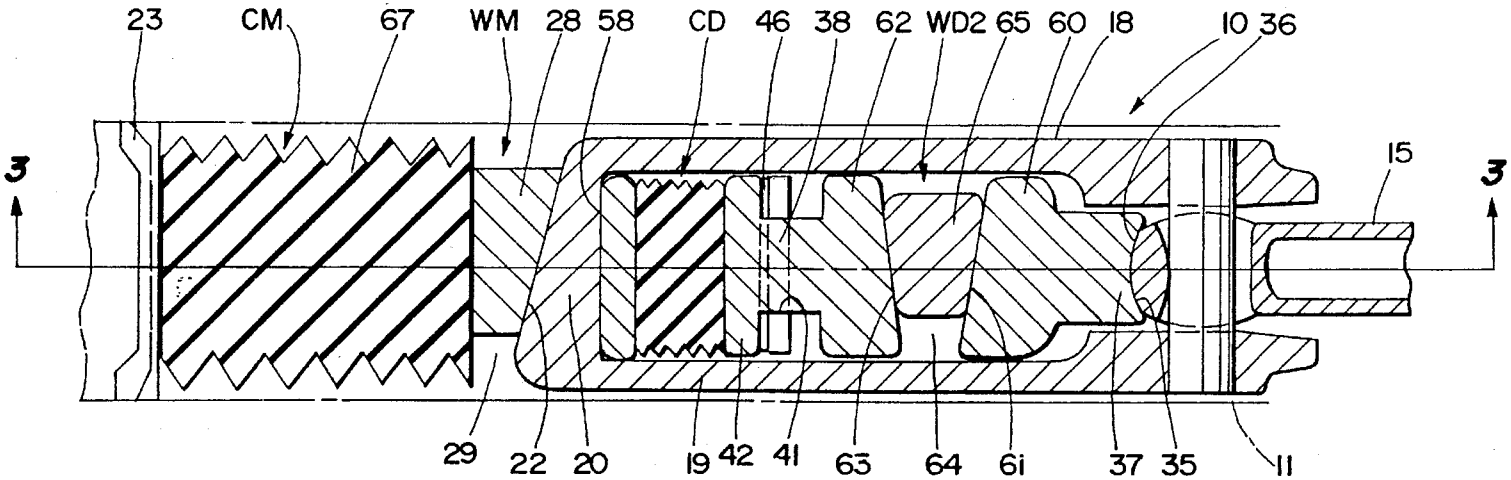
FIG. 4, is a side view of the section of the second embodiment of the invention, as seen from the line 4—4 of FIG. 3.

With particular reference to the second embodiment of the invention shown in FIGS. 3 and 4, the design of the yoke 14 is slightly different from that previously described; namely, each one of the yoke straps 18 and 19 has a bifurcated end which includes a pair of laterally aligned and spaced abutments 56 and 57 for engaging the front stops 25 and 26 of the striker 12 to limit forward axial movement of the yoke 14. Also, the back end 20 of the yoke 14 has an inner side 58 which is not sloped, as previously described, but vertically disposed at right angles to the yoke straps 18 and 19, to abut the similarly disposed back end 43 of the housing 40 of a similar, first cushioning device CD, as previously described, which is now positioned in axially aligned relation behind a different, second wedging device WD2 which is closer to the front stops 25 and 26 of the striker 12 than the first cushioning device CD.

The second wedging device WD2 includes, I) a generally triangular or wedge shaped, first member 60 which is attached to the front follower 37 and extends as a tail rearwardly therefrom in a direction towards the rear stops 23 and 24 of the carsill 11, the first member 60 having a flat, rearwardly facing back side or surface 61 which confronts the cushioning device CD and slopes downwardly in a direction towards the rear stops 23 and 24 of the carsill 11, and II) a generally triangular or wedge shaped, second member 62 which is oppositely disposed to the first member 60, and which has a forwardly facing front side or surface 63 that confronts the first member 60 and slopes downwardly in a direction towards the front stops 25 and 26 of the striker 12, the confronting sloped surfaces 61 and 63 of the first and second members 60 and 62 forming between them a V-shaped space or notch 64, and III) a movable and matingly shaped, twin tapered, third wedge 65 positioned in the notch 64 and designed to fall, by gravity, deeper into the notch 64, when it widens and increases, in size, as slack develops within the yoke 14. The second member 62 has a similar T-shaped tail 38 which extends rearwardly into the housing 40 of the cushioning device CD for the purposes intended, as previously described. The cushion pad 39 of this cushioning device CD can also be preloaded, if desired, as previously explained.

A load cushioning mechanism, generally indicated at CM, is positioned outside the yoke 14 between the outside wedging mechanism WM and the rear stops 23 and 24 on the carsill 11, to help cushion loads impacting the coupling mechanism 10 and yoke 14. The outside cushioning mechanism CM, in this instance, consists of a single, resilient cushion pad 67, as previously described.

Thus, there has been described, a second embodiment which essentially comprises, I) a slack eliminating wedging device within the yoke 14, in tandem, with a single cushioning device which is behind the wedging device, and II) a slack eliminating wedging mechanism disposed outside the yoke 14, in tandem, with a cushioning mechanism which is between the wedging mechanism and the rear stops 23 and 24 of the carsill 11.

Figure 5:
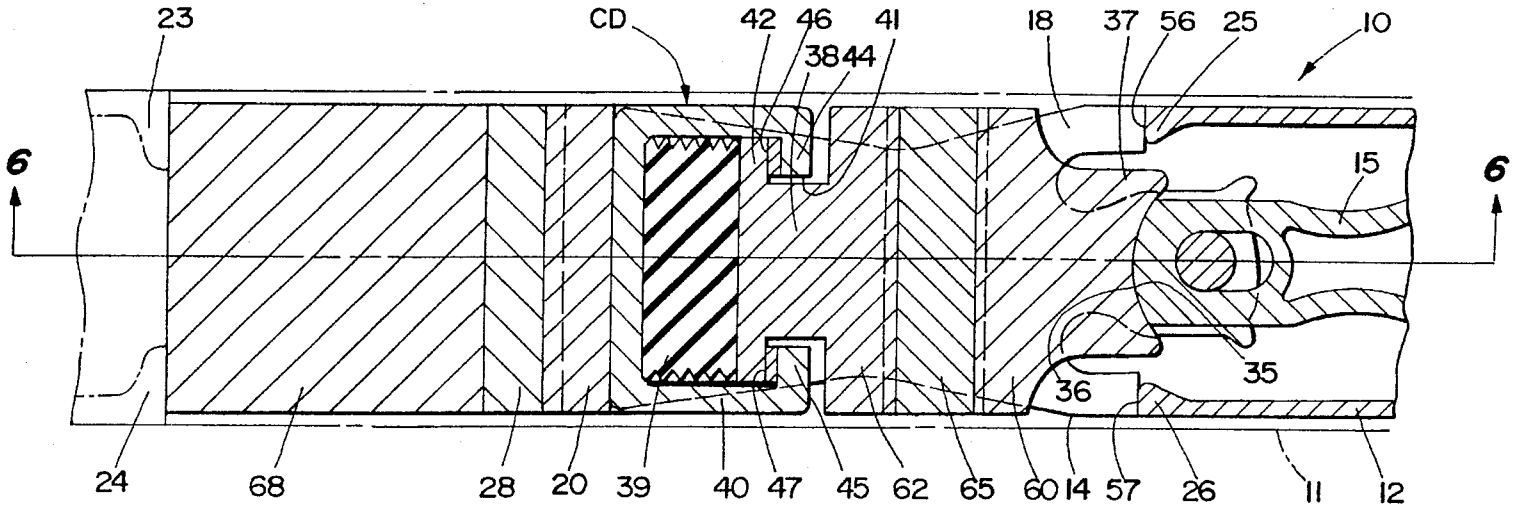
FIG. 5 is a plan view of a section of a third embodiment of the invention, as seen from the line 5—5 of FIG. 6.
Figure 6:
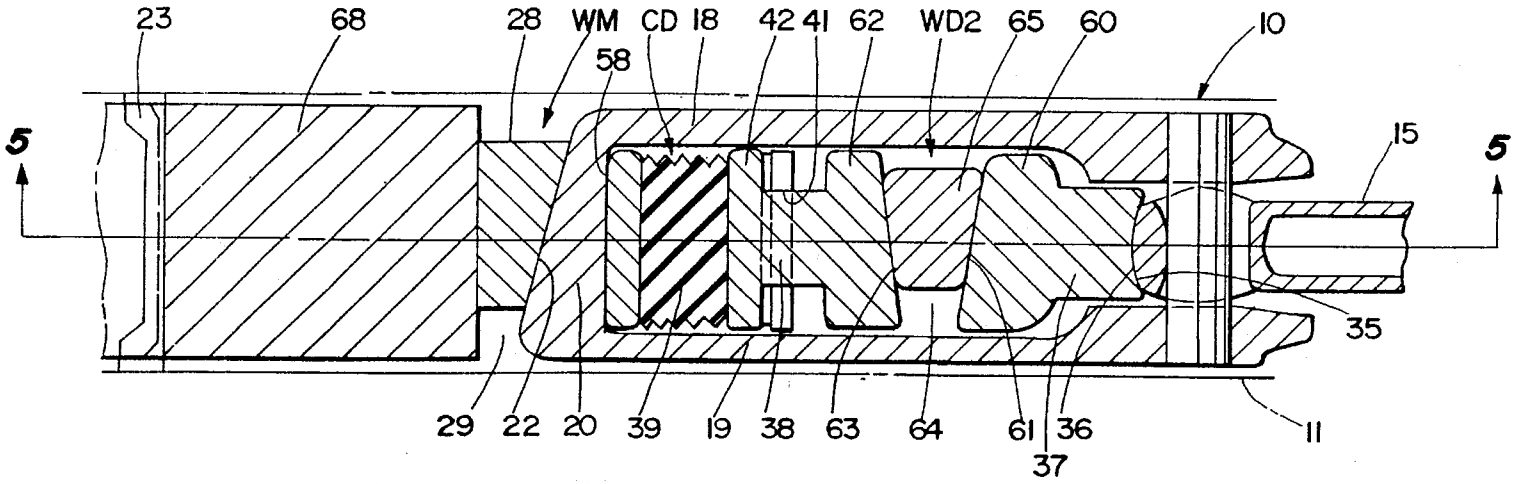
FIG. 6 is a side view of a section of the third embodiment of the invention, as seen from the line 6—6 of FIG. 5.

With particular reference to FIGS. 5 and 6, the third embodiment of the invention shown therein, is identical to the second embodiment of FIGS. 3 and 4, except that the outside cushioning mechanism CM is replaced by any suitable space filling mechanism or device 68, such as a fabricated steel filler block which is sized and shaped to fill the space between the rear stops 23 and 24 and the outside, slack eliminating wedge 25. This third embodiment is disclosed, because the use of an outside cushioning mechanism CM may be thought or found to be undesirable by an end user of the coupling mechanism 10.

Figure 7:
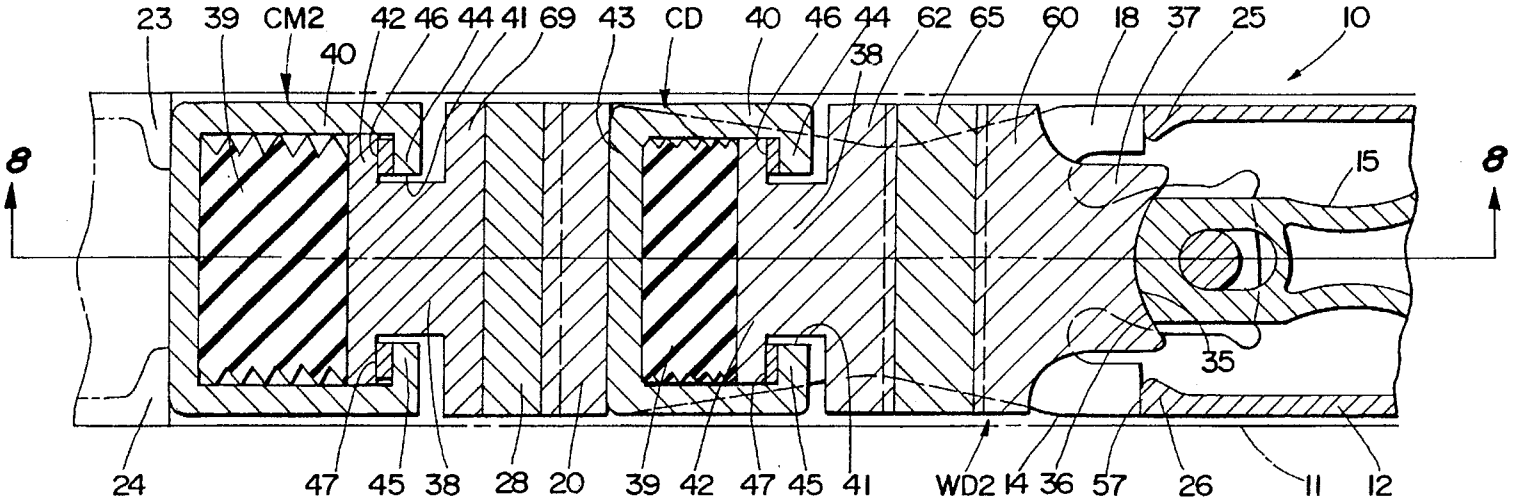
FIG. 7 is a plan view of a section of a fourth embodiment of the invention, as seen from the line 7—7 of FIG. 8.
Figure 8:
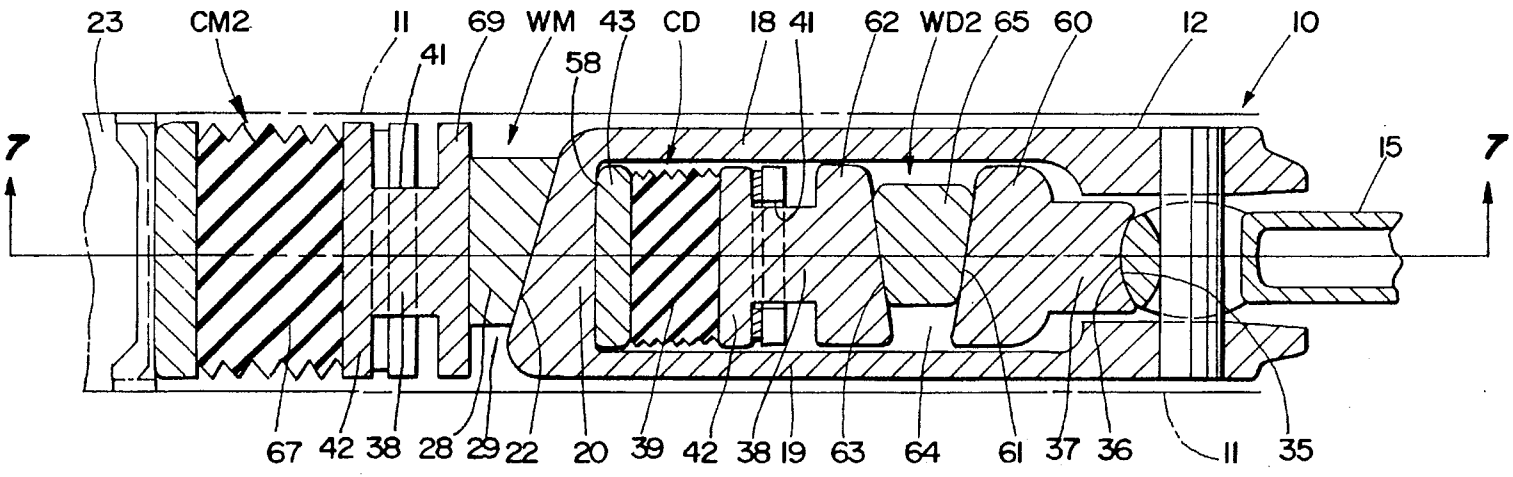
FIG. 8 is a side view of a section of the fourth embodiment of the invention, as seen from the line 8—8 of FIG. 7.

With particular reference to FIGS. 7 and 8, there is shown a fourth embodiment which employs within the yoke 14, an identical cushioning device CD and second wedging device WD2, as previously located and described in connection with the second and third embodiments. A different, second load cushioning mechanism CM2, is disposed outside the yoke 14 between the wedging mechanism WM and the rear stops 23 and 24 of the carsill 11. The second load cushioning mechanism CM2 is similar to the load cushioning device CD provided within the yoke 14. The similar T-shaped tail 38 which extends from the housing 40 of the second cushioning mechanism CM2, is attached to a vertically disposed flat plate 69 which the outside, slack eliminating wedge 28 is designed to slidably engage.

It can be appreciated from a comparison of the structures of the various embodiments one through four of the invention, that they all have, in common, I) at least one load cushioning device and slack eliminating wedging device disposed, in tandem, within the yoke 14 for cushioning loads impacting the car coupling mechanism 10 and eliminating any slack which develops between the back end 20 of the yoke 14 and the butt end 35 of the coupler shank 15, respectively, and II) a wedging mechanism which is disposed directly behind the back end 20 of the yoke 14 for eliminating slack which develops between the yoke 14 and the front and rear stops 25,26, and 23,24, of the striker 12 and carsill 11, respectively.

In addition, the first embodiment of FIGS. 1 and 2 has, within the yoke 14, a second, resilient load cushioning device CD2 which is mounted, in tandem, with the first load cushioning device CD, and designed to come into play after the first cushioning device CD is compressed a predetermined distance where the front follower 37 engages the vertically aligned front flanges 44 and 45 of the cushion pad housing 40 of the first cushioning device CD.

The second and fourth embodiments of FIGS. 3,4, and 7,8, employ different load cushioning mechanisms CM and CM2 which are disposed outside the yoke 14 in axial alignment with the cushioning device CD which is disposed within the yoke 14. Moreover, in these two embodiments, the second wedging device WD2 is positioned within the yoke 14 in front of the cushioning device CD closer the butt end 35 of the coupler shank 15. The third embodiment of FIGS. 5 and 6, is disclosed to show that either of the load cushioning mechanisms CM or CM2 disposed outside the yoke 14 can, if desired, be replaced by a similarly sized shiming mechanism.

Thus, there has been described a unique railroad car coupling mechanism in which both slack which develops between, I) the components within the yoke and butt end of the shank of a coupler or drawbar, and II) the yoke and the longitudinally spaced stops of the carsill and striker, is eliminated to stabilize the position of the car coupling mechanism within the carsill of the railroad car, contrary to known car coupling mechanisms which are only concerned with the elimination of slack within the yoke.

What is claimed is:

1. A railroad car coupling mechanism for positioning at each end of a railroad car between fixed front and rear stops which are spaced longitudinally on the underside of the car, when the car is in a horizontal position, comprising:

a) a yoke which is designed to extend longitudinally of a railroad car between the front stops, closest an adjacent end of the car, and the rear stops, farthest spaced from the adjacent car end, the yoke having a longitudinal axis and a back end which is closer the rear stops;

b) first means carried by the yoke for engaging the front stops to restrict movement of the back end of the yoke in a direction towards the front stops;

c) second means, separate from the first means, disposed within the yoke for resiliently cushioning loads impacting the car coupling mechanism;

d) third means, separate from the first and second means, disposed within the yoke, in tandem, with the second means for at least substantially eliminating slack which develops when parts, within the yoke, become worn; and e) fourth means, including at least one tapered wedge which is movable transversely of the longitudinal axis of the yoke, disposed outside the yoke between the back end of the yoke and the rear stops for at least substantially eliminating slack which develops between the yoke and rear stops.

2. The car coupling mechanism of claim 1, wherein the second means includes at least one resilient cushion pad which is in a plane which is normal to the longitudinal axis of the yoke.

3. A railroad car coupling mechanism for positioning at each end of a railroad car between fixed front and rear stops which are spaced longitudinally on the underside of the car, when the car is in a horizontal position, comprising:

a) a yoke which is designed to extend longitudinally of a railroad car between the front stops, closest an adjacent end of the car, and the rear stops, farthest spaced from the adjacent car end, the yoke having a longitudinal axis and a back end which is closer the rear stops;

b) first means carried by the yoke for engaging the front stops to restrict movement of the back end of the yoke in a direction towards the front stops;

c) second means, separate from the first means, disposed within the yoke for resiliently cushioning loads impacting the car coupling mechanism, the second means including at least one resilient cushion pad which is in a plane which is normal to the longitudinal axis of the yoke;

d) third means, separate from the first and second means, disposed within the yoke, in tandem, with the second means for at least substantially eliminating slack which develops when parts, within the yoke, become worn; and e) fourth means disposed outside the yoke between the back end of the yoke and the rear stops for at least substantially eliminating slack which develops between the yoke and stops, the fourth means including at least one tapered first wedge which is disposed in a matingly shaped space outside the yoke adjacent the back end thereof, and which is designed to fall, by gravity, further into such outside space, when such outside space increases, in size to allow movement of the first wedge therein.

4. The car coupling mechanism of claim 3, wherein the third means includes at least one tapered second wedge which is disposed in a matingly shaped space inside the yoke, and which is designed to fall, by gravity, further into such inside space when such inside space increases, in size, as parts within the yoke become worn and slack develops within the yoke.

5. The car coupling mechanism of claim 4, wherein the back end of the yoke includes an outer surface opposite an inner surface which faces in a direction towards the front stops, the outer surface facing in a direction towards the rear stops and sloping downwardly and in a direction towards the rear stops, such outer surface designed for relative sliding engagement with the first wedge.

6. The car coupling mechanism of claim 5, wherein the yoke includes a pair of straps which extent from the back end of the yoke in parallel relation in a direction towards the front stops, the straps being of the same length, measured longitudinally of the yoke, and terminating at front ends which can be coupled to an adjacent butt end of coupler shank, and the first means includes a pair of laterally spaced and aligned abutments which are carried by each of the straps, adjacent the front end thereof, for abutting engagement with the front stops.

7. The car coupling mechanism of claim 6, which includes:

f) a front follower disposed within the yoke and having therein, a cavity for seating relation with a matingly shaped butt end of a coupler shank;

g) a housing which at least partially surrounds the at least one cushion pad, the housing having a closed back end which is opposite and parallel to a pair of coplanar flanges which are laterally spaced and define between them, an opening which faces the front follower and is in closer spaced relation to the front stops than the back end of the housing; and h) a generally T-shaped tail extending ,from the opening in the housing in a direction towards the front stops and front follower, the tail including a rigid and flat, first plate which is disposed within the housing for compressive engagement with the at least one cushion pad therein.

8. The car coupling mechanism of claim 7, which includes means for preloading the at least one cushion pad within the housing, including at least one rigid shim disposed between each flange of the housing and the first plate of the tail, the at least one shim having a thickness, measured longitudinally of the yoke, which is correlated to a desired preloading of the at least one cushion pad within the housing.

9. The car coupling mechanism of claim 8, wherein the front follower is designed to seat the butt end of a shank of a railroad car coupler which is selected from the group of couplers consisting of drawbars and AAR Standard knuckle and fixed jaw type couplers.

10. The car coupling mechanism of claim 9, wherein the housing is positioned closer to the front stops than the second wedge and the inside space in which the second wedge is received, and the T-shaped tail is centrally attached to the front follower, and the inside space for the second wedge includes a pair of sloping surfaces which converge in a downward direction, one of the pair of sloping surfaces being the inner surface of the back end of the yoke, the other of the pair of converging sloped surfaces being a rearwardly facing surface of a rigid, second plate which is substantially disposed in a plane that is normal to the longitudinal axis of the yoke.

11. The car coupling mechanism of claim 10, which includes at least one resilient cushion pad disposed between the second plate and the back end of the housing, and which acts to cushion loads impacting the yoke, when the front follower moves back in a direction away from the front stops into engagement with the flanges of the housing, after which the front follower and housing move as a unit into compressive engagement with the at least one cushion pad between the housing and second plate.

12. The car coupling mechanism of claim 11, which includes at least one rigid shim disposed between the rear stops and the first wedge.

13. The car coupling mechanism of claim 11, which includes at least one resilient cushion pad disposed between the rear stops and the first wedge.

14. The car coupling mechanism of claim 9, wherein the housing with the at least one cushion pad therein, is positioned adjacent the back end of the yoke, and the inside space with the second wedge therein, is located between the housing and the front follower.

15. The car coupling mechanism of claim 14, wherein the T-shaped tail extending from the housing is centrally attached to a wedge shaped first member which confronts a wedge shaped second member that is oppositely disposed to the first member, the second member being attached to the front follower.

16. The car coupling mechanism of claim 15, wherein the second wedge and matingly shaped space are located between the first and second wedge shaped members.

17. The car coupling mechanism of claim 16, wherein the space for receiving the second wedge is formed between confronting, sloping surfaces of the first and second members, which surfaces converge in a downward direction.

18. The car coupling mechanism of claim 17, which includes at least one rigid shim disposed between the rear stops and the first wedge.

19. The car coupling mechanism of claim 17, which includes at least one resilient cushion pad disposed outside the yoke between the rear stops and the first wedge.

20. The car coupling mechanism of claim 19, which includes:

m) a second housing disposed outside the yoke in axially aligned, spaced relation with the yoke, the second housing at least partially enclosing the at least one cushion pad outside the yoke and having, i) a pair of laterally spaced, coplanar, flanges which define an opening which faces the first wedge and back end of the yoke, and ii) a closed back end opposite the flanges; and n) a flat and rigid second plate confronting the outer surface of the back end of the yoke in spaced relation and forming with the outer surface the space for receipt of the first wedge, the second plate having a generally T-shaped tail which extends into the second housing through the opening and which includes a flat and rigid third plate which is disposed within the second housing for compressive engagement with the at least one cushion pad therein.

21. The car coupling mechanism of claim 20, which includes means for preloading the second cushion pad within the second housing, including a second set of rectangular shims disposed between the flanges of the second housing and the adjacent third plate which engages the second cushion pad, the thickness of the shims of the second set, measured longitudinally of the yoke, being correlated to a desired preloading of the second cushion pad.

22. A railroad car coupling mechanism designed to be positioned within a carsill which has a top side which is closest a railroad car when the carsill is attached thereto at each end of a railroad car between front and rear stops which are spaced longitudinally of the carsill, and which are so designated relative to the spacing thereof from the adjacent end of the car, comprising:

a) a yoke having a longitudinal axis and designed to extend longitudinally between the front and rear stops, the yoke including;

i) a back end which is closer the rear stops than a front end thereof which is closer the front stops adjacent the end of an attached railroad car, the back end including an outer surface opposite an inner surface which faces in a direction towards the front stops, the outer surface sloping downward from the top side of the carsill in a direction towards the rear stops, and ii) a pair of parallel straps extending from the back end in a direction towards the front stops and terminating at a front end which can be coupled to the shank of a coupler of the group of couplers consisting of drawbars and AAR Standard knuckle and rigid jaw type couplers;

b) at least one tapered first wedge disposed between the back end of the yoke and the rear stops, the first wedge designed to slidably engage the sloping outer surface of the back end of the yoke and eliminate any slack which develops between the yoke and front and rear stops;

c) a front follower disposed between the yoke straps in spaced relation from the rear stops, the front follower having a parti-spherical cavity which is designed to seat the butt end of a coupler shank;

d) at least one resilient load cushioning device disposed between the yoke straps, the cushioning device including;

p) at least one resilient cushion pad which is disposed in a plane that is normal to the longitudinal axis of the yoke, q) a housing at least partially enclosing the at least one cushion pad, the housing disposed between the front follower and back end of the yoke and having a closed back end opposite a pair of laterally spaced coplanar front flanges which face the front follower and which define between them, an opening into the housing, and r) a first, rigid flat plate disposed between the front flanges and the at least one cushion pad for compressive engagement with such cushion pad, the first plate having a tail which extends therefrom through the opening in a direction towards the front follower;

e) a wedging device disposed between the yoke straps, in tandem, with the load cushioning device and front follower, the wedging device including;

s) at least one pair of confronting, sloping wedging surfaces which form between them, a generally V-shaped space which increases, in size, when slack develops between worn parts within the yoke, and t) a second tapered wedge matingly shaped to fit into the V-shape space and slidably engage the pair of sloping wedging surfaces of the wedging device within the yoke, the second wedge designed to fall, by gravity, further into the space, when the size thereof increases.

23. The railroad car coupling mechanism of claim 22, which includes means for preloading the at least one cushion pad of the load cushioning device, including:

m) a pair of rigid shims disposed between the front flanges and the first plate to compress the first plate against the at least one cushion pad, the shims having the same thickness, measured longitudinally of the yoke, which is correlated to the desired preloading of the load cushioning device.

24. The railroad car coupling mechanism of claim 23, wherein the wedging device is adjacent the back end of the yoke, and the first cushioning device is between the wedging device and the front follower to which the tail of the first plate is attached.

25. The railroad car coupling mechanism of claim 24, which includes a second, resilient load cushioning device disposed between the wedging device and the housing of the first cushioning device, the second load cushioning device including at least one resilient cushion pad which is in a plane that is normal to the longitudinal axis of the yoke.

26. The railroad car coupling mechanism of claim 25, which includes means for filling any space which exists between the rear stops and the first wedge.

27. The railroad car coupling mechanism of claim 23, wherein the at least one load cushioning device is adjacent the back end of the yoke, and the at least one wedging device is between the front follower and the at least one load cushioning device.

28. The railroad car coupling mechanism of claim 27, wherein the at least one wedging device between the yoke straps, includes;

f) a wedge shaped first member attached to the extending tail of the first plate, the first member having a wedging surface which faces the front stops and slopes downward from the top side of the carsill in a direction towards the front stops; and g) a wedge shaped second member which is oppositely disposed to the first member and attached to the front follower, the second member having a wedging surface which confronts the first member and slopes downward from the top side of the carsill in a direction towards the rear stops, the wedging surfaces of the first and second members forming between them the V-shaped space including the second wedge.

29. The railroad car coupling mechanism of claim 28, which includes at least one rigid shim disposed between the rear stops and first wedge.

30. The railroad car coupling mechanism of claim 28, which includes at least one, resilient load cushing mechanism disposed outside the yoke between the rear stops and the first wedge.

31. The railroad car coupling mechanism of claim 30, wherein the resilient load cushioning mechanism outside the yoke, includes;

i) at least one resilient cushion pad;

ii) a second housing at least partially enclosing the at least one cushion pad outside the yoke, the second housing having a closed back end opposite a pair of laterally spaced, coplanar front flanges which define between them, an opening which faces the back end of the yoke;

iii) a generally H-shaped member including a pair of parallel, rigid, flat plates, one of which plates is outside the second housing in relative sliding relation with the first wedge, and the other of which pair of plates is disposed within the second housing in parallel spaced relation from the front flanges of the second housing and in abutting relation with the at least one cushion pad within the second housing.

32. The railroad car coupling mechanism of claim 31, which includes means for preloading the at least one cushion pad within the second housing, including a pair of shims disposed between the front flanges and the plate within the second housing, the shims having the same thickness which is correlated to the desired preload.

* * * * *